US010924870B2

(12) United States Patent
Natarajan

(10) Patent No.: US 10,924,870 B2
(45) **Date of Patent: *Feb. 16, 2021**

(54) ACOUSTIC FEEDBACK EVENT MONITORING SYSTEM FOR HEARING ASSISTANCE DEVICES

(71) Applicant: Starkey Laboratories, Inc., Eden Prairie, MN (US)

(72) Inventor: Harikrishna P. Natarajan, Shakopee, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/670,316

(22) Filed: Aug. 7, 2017

(65) Prior Publication Data

US 2018/0027341 A1 Jan. 25, 2018

Related U.S. Application Data

(63) Continuation of application No. 12/644,932, filed on Dec. 22, 2009, now Pat. No. 9,729,976.

(51) Int. Cl.
*H04R 25/00* (2006.01)

(52) U.S. Cl.
CPC ..... *H04R 25/453* (2013.01); *H04R 25/305* (2013.01); *H04R 25/558* (2013.01); *H04R 2225/39* (2013.01); *H04R 2225/41* (2013.01)

(58) Field of Classification Search
CPC .. H04R 25/453; H04R 25/305; H04R 25/558; H04R 2225/39; H04R 2225/41; H04R 25/30; H04R 2430/03
USPC ..... 381/60, 93, 318, 95, 94.3, 94.2; 700/94
See application file for complete search history.

(56) References Cited

U.S. PATENT DOCUMENTS

| | | | |
|---|---|---|---|
| 4,972,482 | A | 11/1990 | Ishiguro et al. |
| 4,972,487 | A | 11/1990 | Mangold et al. |
| 4,989,251 | A | 1/1991 | Mangold |
| 5,170,434 | A | 12/1992 | Anderson |
| 5,604,812 | A | 2/1997 | Meyer |
| 5,606,620 | A | 2/1997 | Weinfurtner |
| 5,659,622 | A | 8/1997 | Ashley |

(Continued)

FOREIGN PATENT DOCUMENTS

| | | | |
|---|---|---|---|
| EP | 250679 | A2 | 1/1988 |
| EP | 0396831 | A2 | 11/1990 |

(Continued)

OTHER PUBLICATIONS

U.S. Appl. No. 11/276,795, U.S. Pat. No. 7,986,790, filed Mar. 14, 2006, System for Evaluating Hearing Assistance Device Settings Using Detected Sound Environment.

(Continued)

*Primary Examiner* — Vivian C Chin
*Assistant Examiner* — Con P Tran
(74) *Attorney, Agent, or Firm* — Schwegman Lundberg & Woessner, P.A.

(57) ABSTRACT

The present disclosure relates to tracking of acoustic feedback events of a hearing assistance device, such as a hearing aid. Information about the acoustic feedback events is stored for analysis. Such information is useful for programming acoustic feedback cancellers and other parameters of a hearing assistance device.

20 Claims, 3 Drawing Sheets

(56) References Cited

U.S. PATENT DOCUMENTS

| | | | | |
|---|---|---|---|---|
| 5,838,806 | A | 11/1998 | Sigwanz et al. | |
| 5,987,146 | A | 11/1999 | Pluvinage et al. | |
| 5,991,419 | A | 11/1999 | Brander | |
| 6,044,183 | A | 3/2000 | Pryor | |
| 6,104,993 | A | 8/2000 | Ashley | |
| 6,275,596 | B1 | 8/2001 | Fretz et al. | |
| 6,882,736 | B2 | 4/2005 | Dickel et al. | |
| 7,068,802 | B2 | 6/2006 | Schulz et al. | |
| 7,088,835 | B1 | 8/2006 | Norris et al. | |
| 7,349,549 | B2 | 3/2008 | Bachler et al. | |
| 7,428,312 | B2 | 9/2008 | Meier et al. | |
| 7,889,879 | B2 | 2/2011 | Dillon et al. | |
| 7,986,790 | B2 | 7/2011 | Zhang et al. | |
| 8,103,019 | B1 * | 1/2012 | Pandey | H04R 3/02 381/93 |
| 8,116,473 | B2 | 2/2012 | Salvetti et al. | |
| 8,571,244 | B2 | 10/2013 | Salvetti | |
| 8,638,949 | B2 | 1/2014 | Zhang et al. | |
| 8,917,891 | B2 | 12/2014 | Natarajan | |
| 8,942,398 | B2 | 1/2015 | Salvetti et al. | |
| 9,654,885 | B2 | 5/2017 | Natarajan | |
| 9,729,976 | B2 | 8/2017 | Natarajan | |
| 2002/0012438 | A1 | 1/2002 | Leysieffer et al. | |
| 2002/0025055 | A1 | 2/2002 | Stonikas et al. | |
| 2002/0039426 | A1 | 4/2002 | Takemoto et al. | |
| 2002/0051546 | A1 | 5/2002 | Bizjak | |
| 2002/0057814 | A1 | 5/2002 | Kaulberg | |
| 2003/0112988 | A1 | 6/2003 | Naylor | |
| 2004/0125973 | A1 | 7/2004 | Fang et al. | |
| 2004/0136557 | A1 | 7/2004 | Kaulberg | |
| 2004/0190739 | A1 | 9/2004 | Bachler et al. | |
| 2004/0218772 | A1 | 11/2004 | Ryan | |
| 2005/0129262 | A1 | 6/2005 | Dillon et al. | |
| 2006/0173259 | A1 | 8/2006 | Flaherty et al. | |
| 2006/0215860 | A1 | 9/2006 | Wyrsch | |
| 2007/0036280 | A1 | 2/2007 | Roeck et al. | |
| 2007/0116308 | A1 | 5/2007 | Zurek et al. | |
| 2007/0117510 | A1 | 5/2007 | Elixmann | |
| 2007/0217620 | A1 | 9/2007 | Zhang et al. | |
| 2007/0269065 | A1 | 11/2007 | Kilsgaard | |
| 2007/0280487 | A1 | 12/2007 | Ura et al. | |
| 2008/0019547 | A1 | 1/2008 | Baechler | |
| 2008/0037798 | A1 | 2/2008 | Baechler et al. | |
| 2008/0063228 | A1 | 3/2008 | Mejia et al. | |
| 2008/0107296 | A1 | 5/2008 | Bachler et al. | |
| 2008/0260190 | A1 | 10/2008 | Kidmose | |
| 2009/0245552 | A1 | 10/2009 | Salvetti | |
| 2010/0111339 | A1 | 5/2010 | Sira | |
| 2011/0150231 | A1 | 6/2011 | Natarajan | |
| 2011/0249846 | A1 | 10/2011 | Natarajan | |
| 2011/0249847 | A1 | 10/2011 | Salvetti et al. | |
| 2012/0155664 | A1 | 6/2012 | Zhang et al. | |
| 2016/0183010 | A1 | 6/2016 | Natarajan | |
| 2017/0156009 | A9 | 6/2017 | Natarajan | |

FOREIGN PATENT DOCUMENTS

| | | | |
|---|---|---|---|
| EP | 250679 | B1 | 7/1993 |
| EP | 0335542 | B1 | 12/1994 |
| EP | 712263 | A1 | 5/1996 |
| EP | 712263 | B1 | 1/2003 |
| EP | 1256258 | B1 | 3/2005 |
| EP | 1538868 | A2 | 6/2005 |
| EP | 1624719 | A2 | 2/2006 |
| EP | 1708543 | A1 | 10/2006 |
| EP | 1835784 | A1 | 9/2007 |
| EP | 2003928 | A1 | 12/2008 |
| EP | 2106163 | B1 | 3/2013 |
| WO | WO-0154456 | A1 | 7/2001 |
| WO | WO-03098970 | A1 | 11/2003 |
| WO | WO-2009068028 | A1 | 6/2009 |
| WO | WO-2009124550 | A1 | 10/2009 |

OTHER PUBLICATIONS

U.S. Appl. No. 13/189,990, U.S. Pat. No. 8,638,949, filed Jul. 25, 2011, System for Evaluating Hearing Assistance Device Settings Using Detected Sound Environment.

U.S. Appl. No. 12/408,928, U.S. Pat. No. 8,571,244, filed Mar. 23, 2009, Apparatus and Method for Dynamic Detection and Attenuation of Periodic Acoustic Feedback.

U.S. Appl. No. 12/644,932, U.S. Pat. No. 9,729,976, filed Dec. 22, 2009, Acoustic Feedback Event Monitoring System for Hearing Assistance Devices.

U.S. Appl. No. 13/085,042, U.S. Pat. No. 8,942,398, filed Apr. 12, 2011, Methods and Apparatus for Early Audio Feedback Cancellation for Hearing Assistance Devices.

U.S. Appl. No. 13/085,033, U.S. Pat. No. 8,917,891, filed Apr. 12, 2011, Methods and Apparatus for Allocating Feedback Cancellation Resources for Hearing Assistance Devices.

U.S. Appl. No. 14/579,100, U.S. Pat. No. 9,654,885, filed Dec. 22, 2014, Methods and Apparatus for Allocating Feedback Cancellation Resources for Hearing Assistance Devices.

"European Application Serial No. 10252109.3, Communication Pursuant to Article 94(3) EPC dated Dec. 8, 2017", 9 pgs.

"U.S. Appl. No. 11/276,795, Advisory Action dated Jan. 12, 2010", 13 pgs.

"U.S. Appl. No. 11/276,795, Decision on Pre-Appeal Brief Request dated Apr. 14, 2010", 2 pgs.

"U.S. Appl. No. 11/276,795, Examiner Interview Summary dated Feb. 9, 2011", 3 pgs.

"U.S. Appl. No. 11/276,795, Examiner Interview Summary dated Mar. 11, 2011", 1 pg.

"U.S. Appl. No. 11/276,795, Final Office Action dated Oct. 14, 2009", 15 pgs.

"U.S. Appl. No. 11/276,795, Final Office Action dated Nov. 24, 2010", 17 pgs.

"U.S. Appl. No. 11/276,795, Non Final Office Action dated May 7, 2009", 13 pgs.

"U.S. Appl. No. 11/276,795, Non Final Office Action dated May 27, 2010", 14 pgs.

"U.S. Appl. No. 11/276,795, Notice of Allowance dated Mar. 18, 2011", 12 pgs.

"U.S. Appl. No. 11/276,795, Pre-Appeal Brief Request dated Feb. 16, 2010", 4 pgs.

"U.S. Appl. No. 11/276,795, Response filed Jan. 24, 2011 to Final Office Action dated Nov. 24, 2010", 11 pgs.

"U.S. Appl. No. 11/276,795, Response filed Sep. 8, 2009 to Non Final Office Action dated May 7, 2009", 10 pgs.

"U.S. Appl. No. 11/276,795, Response filed Sep. 28, 2010 to Non Final Office Action dated May 27, 2010", 6 pgs.

"U.S. Appl. No. 11/276,795, Response filed Dec. 14, 2009 to Final Office Action dated Oct. 14, 2009", 10 pgs.

"U.S. Appl. No. 12/408,928, Non Final Office Action dated Aug. 4, 2011", 25 pgs.

"U.S. Appl. No. 12/408,928, Notice of Allowance dated May 11, 2012", 9 pgs.

"U.S. Appl. No. 12/408,928, Notice of Allowance dated Jun. 24, 2013", 10 pgs.

"U.S. Appl. No. 12/408,928V, Preliminary Amendment filed Jun. 22, 2011", 11 pgs, Supplemental.

"U.S. Appl. No. 12/408,928, Preliminary Amendment dated Jun. 24, 2009", 3 pgs.

"U.S. Appl. No. 12/408,928, Response filed Feb. 6, 2012 to Non Final Office Action dated Aug. 4, 2011", 23 pgs.

"U.S. Appl. No. 12/644,932, Advisory Action dated Jun. 17, 2015", 3 pgs.

"U.S. Appl. No. 12/644,932, Advisory Action dated Sep. 28, 2016", 4 pgs.

"U.S. Appl. No. 12/644,932, Final Office Action dated Mar. 18, 2013", 24 pgs.

"U.S. Appl. No. 12/644,932, Final Office Action dated Apr. 3, 2015", 28 pgs.

"U.S. Appl. No. 12/644,932, Final Office Action dated Jul. 8, 2016", 32 pgs.

"U.S. Appl. No. 12/644,932, Non Final Office Action dated Jan. 5, 2016", 29 pgs.

(56) References Cited

OTHER PUBLICATIONS

"U.S. Appl. No. 12/644,932, Non Final Office Action dated Oct. 8, 2014", 27 pgs.
"U.S. Appl. No. 12/644,932, Non Final Office Action dated Nov. 18, 2016", 7 pgs.
"U.S. Appl. No. 12/644,932, Non Final Office Action dated Dec. 29, 2011", 14 pgs.
"U.S. Appl. No. 12/644,932, Notice of Allowance dated Apr. 7, 2017", 9 pgs.
"U.S. Appl. No. 12/644,932, Response filed Feb. 9, 2015 to Non Final Office Action dated Oct. 8, 2014", 11 pgs.
"U.S. Appl. No. 12/644,932, Response filed Feb. 17, 2017 to Non Final Office Action dated Nov. 18, 2016", 7 pgs.
"U.S. Appl. No. 12/644,932, Response filed Apr. 5, 2016 to Non Final Office Action dated Jan. 5, 2016", 11 pgs.
"U.S. Appl. No. 12/644,932, Response filed Jun. 3, 2015 to Final Office Action dated Apr. 3, 2015", 11 pgs.
"U.S. Appl. No. 12/644,932, Response filed Jun. 28, 2012 to Non Final Office Action dated Dec. 29, 2011", 12 pgs.
"U.S. Appl. No. 12/644,932, Response filed Sep. 13, 2013 to Final Office Action dated Mar. 18, 2013", 14 pgs.
"U.S. Appl. No. 13/085,033, Advisory Action dated Nov. 7, 2013", 3 pgs.
"U.S. Appl. No. 13/085,033, Corrected Notice of Allowance dated Sep. 19, 2014", 4 pgs.
"U.S. Appl. No. 13/085,033, Final Office Action dated Aug. 26, 2013", 12 pgs.
"U.S. Appl. No. 13/085,033, Non Final Office Action dated Mar. 6, 2014", 12 pgs.
"U.S. Appl. No. 13/085,033, Non Final Office Action dated May 2, 2013", 10 pgs.
"U.S. Appl. No. 13/085,033, Non Final Office Action dated Nov. 9, 2012", 9 pgs.
"U.S. Appl. No. 13/085,033, Notice of Allowance dated Aug. 12, 2014", 9 pgs.
"U.S. Appl. No. 13/085,033, Response filed Apr. 9, 2013 to Non Final Office Action dated Nov. 9, 2012", 8 pgs.
"U.S. Appl. No. 13/085,033, Response filed Jun. 17, 2014 to Non Final Office Action dated Mar. 6, 2014", 9 pgs.
"U.S. Appl. No. 13/085,033, Response filed Aug. 2, 2013 to Non Final Office Action dated May 2, 2013", 8 pgs.
"U.S. Appl. No. 13/085,033, Response filed Oct. 28, 2013 to Final Office Action dated Aug. 26, 2013", 10 pgs.
"U.S. Appl. No. 13/085,042, Final Office Action dated May 6, 2013", 10 pgs.
"U.S. Appl. No. 13/085,042, Non Final Office Action dated Nov. 9, 2012", 9 pgs.
"U.S. Appl. No. 13/085,042, Notice of Allowance dated Mar. 17, 2014", 5 pgs.
"U.S. Appl. No. 13/085,042, Notice of Allowance dated Jul. 25, 2013", 6 pgs.
"U.S. Appl. No. 13/085,042, Notice of Allowance dated Sep. 22, 2014", 5 pgs.
"U.S. Appl. No. 13/085,042, Response filed Apr. 9, 2013 to Non Final Office Action dated Nov. 9, 2012", 8 pgs.
"U.S. Appl. No. 13/085,042, Response filed Jul. 8, 2013 to Final Office Action dated May 6, 2013", 8 pgs.
"U.S. Appl. No. 13/189,990, Advisory Action dated Aug. 1, 2013", 3 pgs.
"U.S. Appl. No. 13/189,990, Examiner Interview Summary dated Sep. 18, 2013", 1 pgs.
"U.S. Appl. No. 13/189,990, Final Office Action dated May 22, 2013", 15 pgs.
"U.S. Appl. No. 13/189,990, Non Final Office Action dated Nov. 26, 2012", 12 pgs.
"U.S. Appl. No. 13/189,990, Notice of Allowance dated Sep. 18, 2013", 15 pgs.
"U.S. Appl. No. 13/189,990, Preliminary Amendment filed Mar. 5, 2012", 7 pgs.
"U.S. Appl. No. 13/189,990, Response filed Feb. 27, 2013 to Non Final Office Action dated Nov. 26, 2012", 8 pgs.
"U.S. Appl. No. 13/189,990, Response filed Jul. 22, 2013 to Final Office Action dated May 22, 2013", 8 pgs.
"U.S. Appl. No. 14/579,100, Non Final Office Action dated Apr. 27, 2016", 10 pgs.
"U.S. Appl. No. 14/579,100, Notice of Allowance dated Jan. 17, 2017", 9 pgs.
"U.S. Appl. No. 14/579,100, Preliminary Amendment filed Dec. 23, 2015", 6 pgs.
"U.S. Appl. No. 14/579,100, Response filed Aug. 29, 2016 to Non Final Office Action dated Apr. 27, 2016", 8 pgs.
"U.S. Appl. No. 14/579,100, Supplemental Preliminary Amendment filed Mar. 2, 2016", 3 pgs.
"U.S. Appl. No. 12/644,932, Response filed Sep. 8, 2016 to Final Office Action dated Jul. 8, 2016", 10 pgs.
"European Application Serial No. 07250920.1, Extended European Search Report dated May 11, 2007", 6 pgs.
"European Application Serial No. 07250920.1, Office Action dated Apr. 4, 2014", 6 pgs.
"European Application Serial No. 07250920.1, Office Action dated Sep. 27, 2011", 5 pgs.
"European Application Serial No. 07250920.1, Preliminary Amendment filed Mar. 17, 2008", 7 pgs.
"European Application Serial No. 07250920.1, Response filed Feb. 1, 2012 to Office Action dated Sep. 27, 2011", 15 pgs.
"European Application Serial No. 09250817.5, Amendment filed Jun. 22, 2011", 25 pgs.
"European Application Serial No. 09250817.5, Extended European Search Report dated Nov. 18, 2010", 7 pgs.
"European Application Serial No. 10252109.3, Amendment filed Jul. 16, 2013", 18 pgs.
"European Application Serial No. 10252109.3, Examination Notification Art. 94(3) dated Jun. 8, 2015", 6 pgs.
"European Application Serial No. 10252109.3, Extended Search Report dated Dec. 18, 2012", 8 pgs.
"European Application Serial No. 10252109.3, Office Action dated Jan. 21, 2013", 2 pgs.
"European Application Serial No. 10252109.3, Response filed Nov. 16, 2015 to Examination Notification Art. 94(3)dated Jul. 8, 2015", 10 pgs.
Mueller, H. Gustav, "Data logging: It's popular, but how can this feature be used to help patients?", Hearing Journal, 60(10), (Oct. 1, 2007), 6 pgs.
Preves, David A., "Field Trial Evaluations of a Switched Directional/Omnidirectional In-the-Ear Hearing Instrument", Journal of the American Academy of Audiology, 10(5), (May 1999), 273-283.
Taylor, Jennifer Suzanne, "Subjective versus objective measures of daily listening environments", Independent Studies and Capstones. Paper 492. Program in Audiology and Communication Sciences, Washington University School of Medicine., http://digitalcommons.wustl.edu/pacs_capstones/492, (2007), 50 pgs.
"European Application Serial No. 10252109.3, Response filed Apr. 18, 2018 to Communication Pursuant to Article 94(3) EPC dated Dec. 8, 2017", 8 pgs.

* cited by examiner

ACOUSTIC FEEDBACK EVENT MONITORING SYSTEM FOR HEARING ASSISTANCE DEVICES

CROSS-REFERENCE TO RELATED APPLICATION

This application is a continuation of U.S. patent application Ser. No. 12/644,932, filed Dec. 22, 2009, now issued as U.S. Pat. No. 9,729,976, which is incorporated by reference herein in its entirety.

RELATED APPLICATION

This application is related to U.S. patent application Ser. No. 11/276,795, filed Mar. 14, 2006, which is also published as U.S. Patent Application Publication No. 2007/0217620 on Sep. 20, 2007, and titled: "SYSTEM FOR EVALUATING HEARING ASSISTANCE DEVICE SETTINGS USING DETECTED SOUND ENVIRONMENT," which documents are all incorporated by reference in their entirety.

FIELD OF THE INVENTION

The present subject matter relates generally to hearing assistance devices, including, but not limited to hearing aids, and in particular to an acoustic feedback event monitoring system for hearing assistance devices.

BACKGROUND

Modern hearing assistance devices typically include digital electronics to enhance the wearer's experience. In the specific case of hearing aids, current designs employ digital signal processors rich in features. Modern hearing aids include acoustic feedback cancellation functions. Acoustic feedback cancellation provides very rapid correction of the response of the hearing aid to avoid acoustic feedback. It is difficult to adjust settings of an acoustic feedback cancellation system because they are not limited to electronic or software aspects. These settings are also a function of the acoustics of the environment experienced by the wearer of the device and the fit of the device for the particular wearer.

With the increase of the use of open fit configuration hearing assistance devices, such as receiver-in-the-canal (RIC) or receiver-in-the-ear (RITE) hearing aids, there is an increasing need for higher gain solutions and thus more attention is placed squarely on the acoustic feedback cancellation function. It is important to obtain as much information about the acoustic feedback experienced by the wearer and the operation of the acoustic feedback canceller to provide the desired higher gains with reduced feedback problems for hearing aid wearers.

Audiologists have struggled with lack of information regarding feedback problems that the wearer experienced in use of the hearing aids. Information such as the band at which feedback happens or the severity of the problem is not easy to get from the hearing aid wearer. This may lead to unnecessary reduction in gain at places where feedback is not of a problem resulting in reduced audibility and an unhappy customer.

The options available currently in the market for audiologists are limited. Information that is currently available for an audiologist is typically limited to patient's feedback condition while in the audiologist office. This information is limited and time consuming to acquire.

What is needed in the art is a system for improved monitoring of acoustic feedback events for hearing assistance devices. The system should provide robust and easily accessible information to allow for improved adjustment of hearing assistance devices.

SUMMARY

Disclosed herein, among other things, are methods and apparatus for hearing assistance devices, including, but not limited to hearing aids, and in particular to an acoustic feedback event monitoring system for hearing assistance devices.

The present disclosure relates to tracking of acoustic feedback events of a hearing assistance device, such as a hearing aid. Information about the acoustic feedback events is stored for analysis. Such information is useful for programming acoustic feedback cancellers and other parameters of a hearing assistance device.

In various embodiments, the present subject matter provides apparatus for storing information relating to acoustic feedback events of a hearing assistance device, including a microphone; a receiver; a digital signal processor adapted to process an input signal and generate an output signal, the digital signal processor adapted to perform a process to reduce acoustic feedback between the receiver and the microphone, the digital signal processor further adapted to store information relating to the acoustic feedback events over an extended period of use of the hearing assistance device, wherein the information is accessible for analysis to determine aspects of the acoustic feedback experienced by the hearing assistance device over the extended period of use, the extended period of use including different acoustic environments experienced by a wearer of the hearing assistance device during use of the hearing assistance device. Various embodiments provide multiband or subband approaches. Various embodiments provide storage on the hearing assistance device and remote from the hearing assistance device. Various embodiments store information including one or more of a total number of occurrences of a feedback event, a severity of a feedback event, or a number of feedback events per unit time. Various embodiments include but are not limited to different types of hearing aids, such as behind-the-ear, in-the-ear, and receiver-in-the-canal hearing aids. In various embodiments, wireless communications are provided to perform storage and/or transfer of the information.

Various embodiments provide methods for monitoring performance of a hearing assistance device having an acoustic feedback canceller, the methods including tracking information about a plurality of acoustic feedback events over an extended time interval of use of the hearing assistance device to monitor performance of the acoustic feedback canceller in different acoustic environments experienced by a wearer of the hearing assistance device; and storing the information for analysis. Various embodiments provide multiband or subband approaches. Various embodiments provide storage on the hearing assistance device and remote from the hearing assistance device. Various embodiments store information including one or more of a total number of occurrences of a feedback event, a severity of a feedback event, or a number of feedback events per unit time. Various embodiments include but are not limited to different types of hearing aids, such as behind-the-ear, in-the-ear, and receiver-in-the-canal hearing aids. In various embodiments, wireless communications are provided to perform storage and/or transfer of the information.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates generally to hearing assistance devices, including, but not limited to hearing aids, and in particular to an acoustic feedback event monitoring system for hearing assistance devices.

Figure 1:
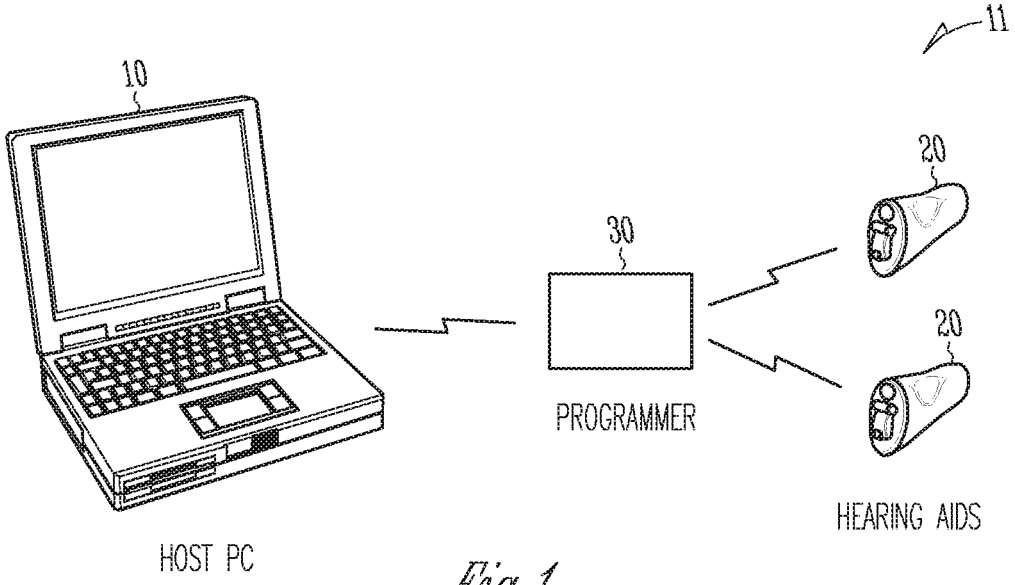
FIG. 1 is a block diagram showing hearing assistance devices and programming equipment, according to one embodiment of the present subject matter.

FIG. 1 is a block diagram of a system 11 showing a pair of hearing assistance devices and programming equipment, according to one embodiment of the present subject matter. FIG. 1 shows a host computer 10 in communication with the hearing assistance devices 20. In one application, the hearing assistance devices 20 are hearing aids. Other hearing assistance devices and types of hearing aids are possible without departing from the scope of the present subject matter. In various embodiments a programmer 30 is used to communicate with the hearing assistance devices 20; however, it is understood that the programmer functions may be embodied in the host computer 10 and/or in the hearing assistance devices 20 (e.g., hearing aids), in various embodiments. Programmer 30 thus functions to at least facilitate communications between the host computer 10 and the hearing assistance devices 20 (e.g., hearing aids), and may contain additional functionality and programming in various embodiments.

The present subject matter provides a means for tracking acoustic feedback events over an extended period of time. The tracking algorithm executes on each hearing aid to be monitored. In various embodiments, the tracking algorithm is performed by the digital signal processor to save acoustic feedback events for analysis. In various embodiments, it is possible that the tracking algorithm can operate at least in part on another device, including, but not limited to, the host computer 10, the programmer 30, another hearing aid 20, or on combinations of the foregoing. It is possible that the tracking algorithm can be executed on another device provided it accesses or obtains information about the feedback event experienced and/or operation of the feedback canceller as it operates on the hearing assistance device.

A good feedback detector in a multiband device can detect accurately the occurrence of feedback in a particular band. A hearing aid that has stored these feedback events is a good source of information for audiologists during follow up visits from hearing aid users. It is understood that such follow ups need not be in person and that using remote access technology, the feedback event data can be reviewed and processed remotely. Device parameters can be adjusted remotely as well. Upon reviewing the feedback event information, the audiologist can set the gain in the hearing aid to suit audibility needs while making the most educated guess to avoid potential feedback problems. In various embodiments, this can be based on the wearer's hearing loss and any preliminary calculation of maximum stable gain of the hearing aid. The hearing aid wearer is asked to come back for a follow up visit at a later time, such as one or two weeks. Other times may be used without departing from the scope of the present subject matter. During this time a feedback tracking algorithm can be run on the hearing aid, or aids, to be monitored. In various embodiments, the tracking algorithm is continually run on the hearing aid. In various embodiments, the tracking algorithm is activated during the 1 to 2 week monitoring period, depending on the preference of the audiologist. In various embodiments, the tracking algorithm is activated upon certain programmable events, such as an acoustic environment change, occurrence of multiple acoustic feedback events, or other programmable events. In various embodiments, there are means in the fitting software to disable or reset the feedback tracking algorithm.

In some embodiments, the feedback tracking algorithm constantly monitors information including, but not limited to, the total number of occurrences of feedback, severity of the feedback, and/or a number of feedback occurrences per unit time until the next follow up. If needed to avoid false alarms, the feedback tracking algorithm can be disabled for a few seconds after power up so that feedback due to insertion of hearing aid into ear is not taken into consideration. The data is collected over an interval of time until the follow up session.

When the hearing aid user comes back to the audiologist office (or in the case of a remote visit, when the data is provided to the audiologist), the fitting software will display the information that would help the audiologist to fine tune the prescribed gain to minimize feedback problems. This allows gain to be reduced in bands of high feedback problems and increase gain (if needed) in bands with no feedback problems. Higher the probability of feedback in a band, more gain reduction can be prescribed in that band. This will ensure that the hearing aid performance is maximized to provide increased audibility while reducing risks of feedback in a convenient, straight forward manner.

Figure 2:
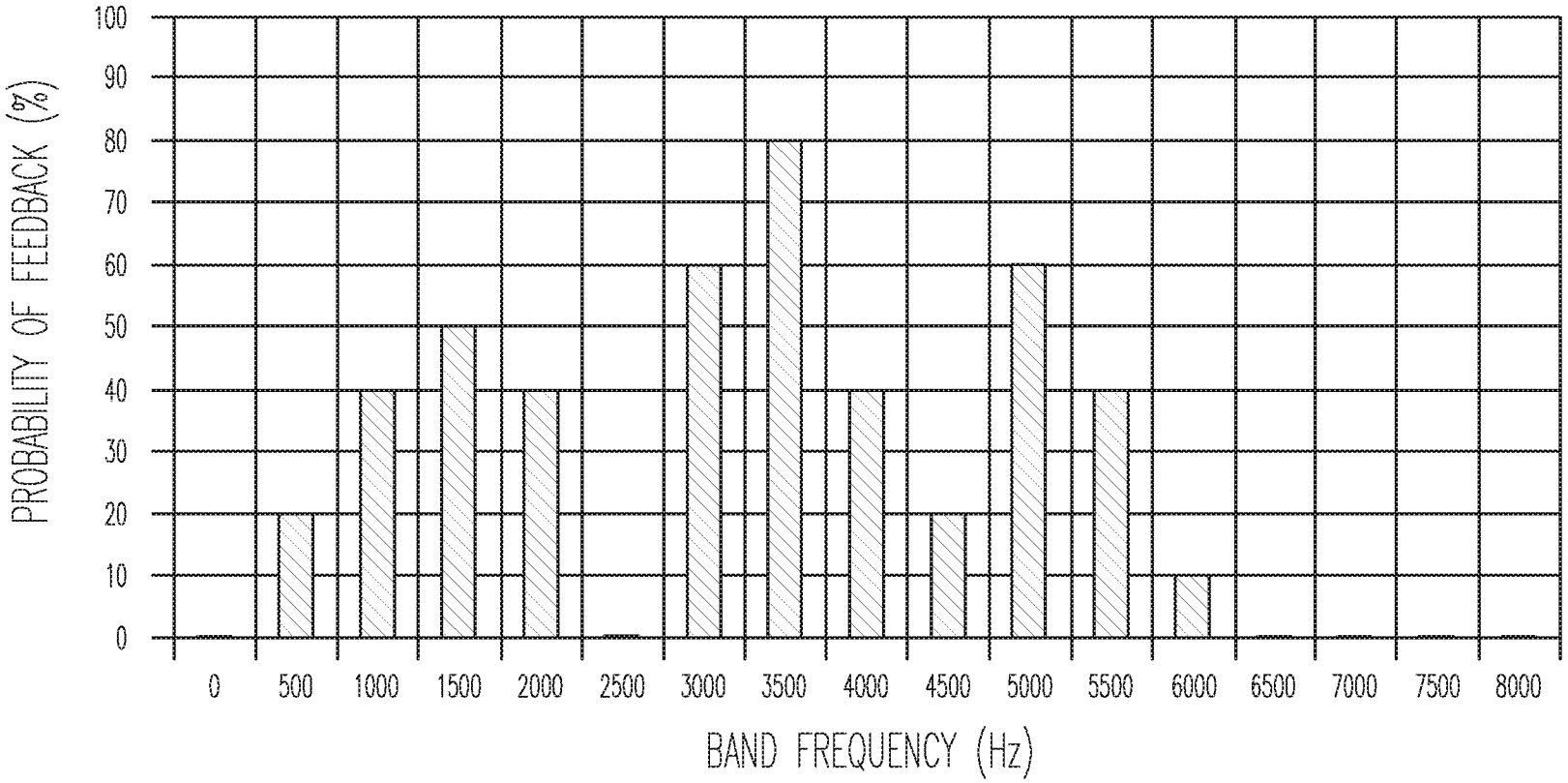
FIG. 2 demonstrates one type of output possible with the present system, according to one embodiment of the present subject matter.

FIG. 2 demonstrates one type of output possible with the present system, according to one embodiment of the present subject matter. The data representing feedback occurrences at particular frequencies is statistically collected and provided as a histogram in this example. This type of output tells the audiologist the likelihood of feedback as a function of frequency for a relatively large sample space as opposed to a limited amount of information found during a patient visit. There are different ways that the fitting software can display the information on feedback. Thus, the present discussion is demonstrative and not intended to be an exhaustive or exclusive depiction of the system and its operation.

In various embodiments, the feedback tracking algorithm is adapted to run on the digital signal processor of the hearing assistance device. In some embodiments, the data is statistically collected and stored in memory resident in the hearing aid. In various embodiments, the data is transferred to another storage device. Such devices include data storage accessible over the INTERNET or other network, a personal data storage, such as a personal digital assistant, iPod, cellular phone, or other digital storage device. Such transfer may be performed in a wired or wireless approach, or via a recharging step where the data is downloaded. The wireless approaches including, but are not limited to radio frequency transmission or magnetic coupling transmission. In some embodiments, the data is logged for later processing, such as set forth in U.S. patent application Ser. No. 11/276,795 filed Mar. 14, 2006, which is also published as U.S. Patent Application Publication No. 2007/0217620 on Sep. 20, 2007, titled: "SYSTEM FOR EVALUATING HEARING ASSISTANCE DEVICE SETTINGS USING DETECTED SOUND ENVIRONMENT," which documents are all incorporated by reference in their entirety.

Figure 3:
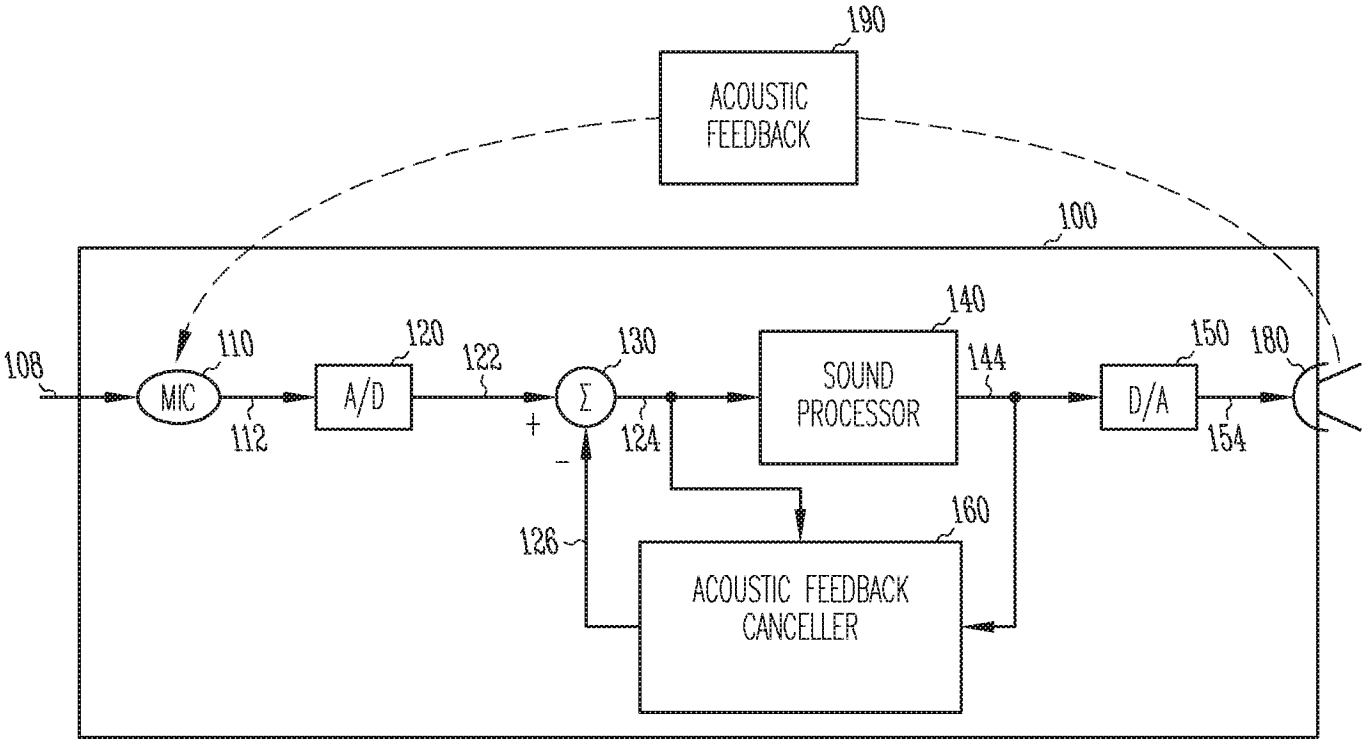
FIG. 3 shows a functional block diagram of a hearing assistance system according to one embodiment of the present invention and a representation of an acoustic feedback path.

FIG. 3 shows a functional block diagram of a hearing assistance system according to one embodiment of the present invention and a representation of an acoustic feedback path. The hearing assistance system 100 includes a microphone 110, which receives input sound 108 and provides a signal 112 to an analog-to-Docket digital converter 120. A digital representation 122 of the signal 112 is provided to the summer 130. The summer 130, sound processor 140 and acoustic feedback estimator with adaptive bulk delay 160 are configured in a negative feedback configuration to provide a cancellation of the acoustic feedback 190. In FIG. 3, the input sound 108 is desired signal and conceptually separate from acoustic feedback 190. In providing the cancellation, signal 124 represents a form of error signal to assist in producing the acoustic feedback estimate 126 from acoustic feedback estimator with adaptive bulk delay 160. Sound processor 140 can be implemented to provide a number of signal processing tasks, at least some of which are found in hearing assistance systems. The resulting processed digital output 144 is received by driver 150 and used to drive receiver 180. In one embodiment, driver 150 is a digital to analog converter and amplifier combination to drive receiver 180. In one embodiment, driver 150 is a direct drive. In one embodiment, driver 150 is a pulse width modulator. In one embodiment, driver 150 is a pulse density modulator. Receiver 180 also can vary. In one embodiment, receiver 180 is a speaker. In on embodiment, receiver 180 is a transducer. Other drivers and receivers may be used without departing from the scope of the present subject matter.

Digital output 144 is provided to the acoustic feedback estimator with adaptive bulk delay 160 to create the acoustic feedback estimate 126. Summer 130 subtracts acoustic feedback estimate 126 from digital representation 122 to create error signal 124.

It is understood that various amplifier stages, filtering stages, and other signal processing stages are combinable with the present teachings without departing from the scope of the present subject matter.

The sound cancellation is necessary since acoustic output from the receiver 180 invariably couples with the microphone 110 through a variety of possible signal paths. Some example acoustic feedback paths may include air paths between the receiver 180 and microphone 110, sound conduction paths via the enclosure of hearing assistance system 100, and sound conduction paths within the enclosure of hearing assistance system 100. Such coupling paths are collectively shown as acoustic feedback 190.

If properly implemented the feedback system of FIG. 3 will produce an acoustic feedback estimate 126 which is closely modeled after acoustic feedback 190. Summer 130 will subtract the acoustic feedback estimate 126 from signal 122, thereby cancelling the effect of acoustic feedback 190 in signal 124. As the cancellation becomes ideal signal 124 approaches signal 122, which is a digital representation of input sound 108. It is noted that signal 124 is called an error signal only because it represents error to the closed loop system (that is when it departs from signal 122 that is error). When working properly, the information on error signal 124 is the desired sound information from input sound 108. Thus, the "error" nomenclature does not mean that the signal is purely error, but rather that its departure from the desired signal indicates error in the closed loop feedback system.

The acoustic feedback cancellation is performed using the digital signal processor (DSP) in digital embodiments. The DSP can be used to perform the feedback event tracking function of the present subject matter. Multiband or subband implementations can involve acoustic feedback cancellation that is performed on a band-by-band basis. Therefore collection of acoustic feedback events per band is relatively straightforward.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method, comprising:

monitoring performance of a hearing assistance device having an acoustic feedback canceller, including tracking information using a processor of the hearing assistance device about acoustic feedback events over an interval of use of the hearing assistance device in different acoustic environments experienced by a wearer of the hearing assistance device, wherein the tracking is activated upon occurrence of a programmable event and wherein the processor is configured to measure a magnitude of severity of a feedback event of the acoustic feedback events and to reduce feedback on a band-by-band basis of a plurality of subbands using the measured magnitude and an acoustic feedback estimate; and storing the tracked information remotely from the hearing assistance device, including storing an indication of the magnitude of severity of the feedback event of the acoustic feedback events for one or more subbands of the plurality subbands, and storing a probability of feedback for the one or more subbands.

2. The method of claim 1, wherein the processor is configured to reduce feedback using the measured magnitude and using subtraction of the acoustic feedback estimate.

3. The method of claim 1, wherein storing the information remotely includes storing the information in digital storage accessible over the INTERNET or other network.

4. The method of claim 1, wherein storing the information remotely includes storing the information in a memory of a personal computer.

5. The method of claim 1, wherein storing the information remotely includes storing the information in a memory of a portable digital storage device.

6. The method of claim 1, further comprising transferring the tracked information from the hearing assistance device to a remote device before storing the tracked information at the remote device.

7. The method of claim 6, wherein transferring the tracked information to a remote device includes using the INTERNET.

8. The method of claim 6, wherein transferring the tracked information to remote device includes using a wireless network.

9. The method of claim 8, wherein transferring the tracked information to a remote device includes using radio frequency transmission.

10. The method of claim 8, wherein transferring the tracked information to a remote device includes using magnetic coupling transmission.

11. An apparatus for storing information relating to acoustic feedback events of a hearing assistance device, comprising:

a digital signal processor configured to monitor performance of a hearing assistance device having an acoustic feedback canceller, including tracking information from a processor of the hearing assistance device about acoustic feedback events over an interval of use of the hearing assistance device in different acoustic environments experienced by a wearer of the hearing assistance device, wherein the tracking is activated upon occurrence of a programmable event and wherein the processor is configured to measure a magnitude of severity of a feedback event of the acoustic feedback events and to reduce feedback on a band-by-band basis of a plurality of subbands using the measured magnitude and an acoustic feedback estimate; and a memory configured to store the tracked information remotely from the hearing assistance device, including storing an indication of the magnitude of severity of the feedback event of the acoustic feedback events for one or more subbands of the plurality subbands, and storing a probability of feedback for the one or more subbands, wherein the information is accessible for analysis to determine aspects of the acoustic feedback experienced by the hearing assistance device over the interval of use.

12. The apparatus of claim 11, further comprising wireless electronics adapted to perform wireless communication of the information.

13. The apparatus of claim 12, wherein the wireless electronics are configured to perform radio frequency communication.

14. The apparatus of claim 12, wherein the wireless electronics are configured to perform magnetic coupling communication.

15. The apparatus of claim 11, wherein the digital signal processor is adapted to store the information including a total number of occurrences of a feedback event.

16. The apparatus of claim 11, wherein the digital signal processor is adapted to store the information including statistical information about acoustic feedback events.

17. The apparatus of claim 11, wherein the digital signal processor is adapted to store the information including a number of feedback events per unit time.

18. The apparatus of claim 11, wherein the apparatus includes a cellular telephone.

19. The apparatus of claim 11, wherein the apparatus includes a portable digital storage device.

20. The apparatus of claim 11, wherein the processor is configured to reduce feedback using the measured magnitude and using subtraction of the acoustic feedback estimate.

* * * * *